US008068727B2

(12) United States Patent
Phillips et al.

(10) Patent No.: US 8,068,727 B2
(45) Date of Patent: Nov. 29, 2011

(54) STORAGE-TYPE WATER HEATER HAVING TANK CONDITION MONITORING FEATURES

(75) Inventors: Andrew William Phillips, Columbia, SC (US); Andrew Robert Caves, Milwaukee, WI (US); Thomas Gerard Van Sistine, Menomonee Falls, WI (US); Ray Oliver Knoeppel, Hartland, WI (US); John Matthew Schulz, Franklin, TN (US)

(73) Assignee: AOS Holding Company, Wilmington, DE (US)

( * ) Notice: Subject to any disclaimer, the term of this patent is extended or adjusted under 35 U.S.C. 154(b) by 873 days.

(21) Appl. No.: 12/021,421

(22) Filed: Jan. 29, 2008

(65) Prior Publication Data

US 2009/0056644 A1 Mar. 5, 2009

Related U.S. Application Data

(60) Provisional application No. 60/968,424, filed on Aug. 28, 2007.

(51) Int. Cl.
*F24H 1/18* (2006.01)

(52) U.S. Cl. ..... 392/441; 392/447; 392/457; 392/451

(58) Field of Classification Search ..... 392/441, 392/447, 451, 449, 457
See application file for complete search history.

(56) References Cited

U.S. PATENT DOCUMENTS 3,037,920 A 6/1962 Vixler
3,066,082 A 11/1962 Marsh et al.
3,132,082 A 5/1964 Overmyer
3,135,677 A 6/1964 Fischer
3,424,665 A 1/1969 Mathews
3,576,556 A 4/1971 Sellors, Jr.
3,644,074 A 2/1972 Cade
3,647,196 A 3/1972 Cotton
3,727,073 A 4/1973 Cade
3,745,231 A 7/1973 Eager, Jr. et al.
3,877,864 A 4/1975 Carlson
3,941,553 A 3/1976 Bedford
(Continued)

FOREIGN PATENT DOCUMENTS

DE 03532058 3/1987
(Continued)

OTHER PUBLICATIONS

Machine translation of DE 10145575, Electrolux Haustechnik GmbH, published Apr. 3, 2003 (2 pages).

(Continued)

*Primary Examiner* — Thor Campbell
(74) *Attorney, Agent, or Firm* — Michael Best & Friedrich LLP

(57) ABSTRACT

Methods and systems for evaluating the condition of a water tank having a powered anode protection system. The water heater includes a storage tank to hold water, a powered anode, and a control circuit. The control circuit includes a variable voltage supply, a voltage sensor, and a current sensor. The control circuit is configured to compare a measured parameter to a threshold. In some constructions, the threshold is indicative of a condition of the storage tank at which the powered anode is no longer able to protect the storage tank from corrosion. In other constructions, the threshold is predicative of a potential failure of the storage tank caused by corrosion. In some constructions, the control circuit is configured to estimate a time remaining until the predicted failure of the storage tank.

31 Claims, 7 Drawing Sheets

U.S. PATENT DOCUMENTS

| | | | |
|---|---|---|---|
| 4,000,961 | A | 1/1977 | Mandock |
| 4,086,048 | A | 4/1978 | Carlson |
| 4,087,742 | A | 5/1978 | Khoo |
| 4,136,001 | A | 1/1979 | Nozaki |
| 4,231,852 | A | 11/1980 | Ruckert |
| 4,255,647 | A | 3/1981 | Rickert et al. |
| 4,306,189 | A | 12/1981 | Nozaki |
| 4,311,576 | A | 1/1982 | Toudo et al. |
| 4,343,987 | A | 8/1982 | Schimbke et al. |
| 4,347,430 | A | 8/1982 | Howard-Leicester et al. |
| 4,395,224 | A | 7/1983 | Cade |
| 4,407,711 | A | 10/1983 | Baboian et al. |
| 4,409,080 | A | 10/1983 | Slough |
| 4,416,618 | A | 11/1983 | Smith |
| 4,434,039 | A | 2/1984 | Baboian et al. |
| 4,444,551 | A | 4/1984 | Mueller et al. |
| 4,453,499 | A | 6/1984 | Palmer |
| 4,457,692 | A | 7/1984 | Erdman |
| 4,518,345 | A | 5/1985 | Mueller et al. |
| 4,527,125 | A | 7/1985 | Miyanaka et al. |
| 4,531,375 | A | 7/1985 | Zinsmeyer |
| 4,589,843 | A | 5/1986 | Smith |
| 4,604,054 | A | 8/1986 | Smith |
| 4,638,789 | A | 1/1987 | Ueki et al. |
| 4,692,591 | A | 9/1987 | Cooler et al. |
| 4,737,102 | A | 4/1988 | Jinno et al. |
| 4,755,267 | A | 7/1988 | Saunders |
| 4,819,587 | A | 4/1989 | Tsutsui et al. |
| 4,922,861 | A | 5/1990 | Tsutsui et al. |
| 4,925,386 | A | 5/1990 | Donnelly et al. |
| 4,972,066 | A | 11/1990 | Houle et al. |
| 4,975,560 | A | 12/1990 | Wardy et al. |
| 4,978,292 | A | 12/1990 | Donnelly et al. |
| 4,986,468 | A | 1/1991 | Deisinger |
| 4,993,401 | A | 2/1991 | Diekmann et al. |
| 5,023,928 | A | 6/1991 | Houlde et al. |
| 5,024,596 | A | 6/1991 | Smith |
| 5,035,607 | A | 7/1991 | Peterson |
| 5,046,944 | A | 9/1991 | Smith |
| 5,053,978 | A | 10/1991 | Solomon |
| 5,056,712 | A | 10/1991 | Enck |
| 5,102,328 | A | 4/1992 | Robinson |
| 5,176,807 | A | 1/1993 | Kumar |
| 5,260,663 | A | 11/1993 | Blades |
| 5,287,060 | A | 2/1994 | Reddy et al. |
| 5,295,818 | A | 3/1994 | Robinson |
| 5,342,493 | A | 8/1994 | Boiko |
| 5,367,602 | A | 11/1994 | Stewart |
| 5,442,157 | A | 8/1995 | Jackson |
| 5,445,719 | A | 8/1995 | Boiko |
| 5,446,348 | A | 8/1995 | Michalek et al. |
| 5,504,430 | A | 4/1996 | Andersson |
| 5,549,469 | A | 8/1996 | Wild et al. |
| 5,660,328 | A | 8/1997 | Momber |
| 5,671,113 | A | 9/1997 | Knepler |
| 5,831,250 | A | 11/1998 | Bradenbaugh |
| 5,872,454 | A | 2/1999 | West |
| 5,949,960 | A | 9/1999 | Hall |
| 6,059,195 | A | 5/2000 | Adams et al. |
| 6,080,973 | A | 6/2000 | Thweatt |
| 6,085,738 | A | 7/2000 | Robinson et al. |
| 6,129,284 | A | 10/2000 | Adams et al. |
| 6,350,967 | B1 | 2/2002 | Scott |
| 6,437,300 | B1 | 8/2002 | Katzman et al. |
| 6,455,820 | B2 | 9/2002 | Bradenbaugh |
| 6,478,947 | B2 | 11/2002 | Nagasaku et al. |
| 6,506,295 | B1 | 1/2003 | Takahashi et al. |
| 6,522,834 | B1 | 2/2003 | Herrick et al. |
| 6,529,841 | B2 | 3/2003 | Cocking et al. |
| 6,561,138 | B2 | 5/2003 | Kobayashi et al. |
| 6,572,364 | B2 | 6/2003 | Kawaucki et al. |
| 6,633,726 | B2 | 10/2003 | Bradenbaugh |
| 6,649,881 | B2 | 11/2003 | Scott et al. |
| 6,690,172 | B2 | 2/2004 | Higo |
| 6,690,173 | B2 | 2/2004 | Blades |
| 6,701,874 | B1 | 3/2004 | Schultz et al. |
| 6,795,644 | B2 | 9/2004 | Bradenbaugh |
| 6,862,165 | B2 | 3/2005 | Chian et al. |
| 6,866,202 | B2 | 3/2005 | Sigafus et al. |
| 6,871,014 | B2 | 3/2005 | Pierre |
| 6,902,661 | B2 | 6/2005 | Thomas et al. |
| 6,930,486 | B2 | 8/2005 | Muscarella et al. |
| 6,942,482 | B2 | 9/2005 | Honda et al. |
| 7,169,288 | B2 | 1/2007 | Drapeau |
| 7,189,319 | B2 | 3/2007 | Al-Mahrous |
| 7,209,651 | B1 | 4/2007 | Knoeppel et al. |
| 7,238,263 | B2 | 7/2007 | Howard, Jr. et al. |
| 7,372,005 | B2 | 5/2008 | Knoeppel et al. |
| 7,706,670 | B2 | 4/2010 | Knoeppel et al. |
| 2001/0020615 | A1 | 9/2001 | Bradenbaugh |
| 2002/0125241 | A1 | 9/2002 | Scott et al. |
| 2003/0063901 | A1 | 4/2003 | Gu et al. |
| 2003/0164708 | A1 | 9/2003 | Park et al. |
| 2004/0161227 | A1 | 8/2004 | Baxter |
| 2005/0006251 | A1 | 1/2005 | Thomas, III et al. |
| 2005/0159844 | A1 | 7/2005 | Sigafus et al. |
| 2006/0083491 | A1 | 4/2006 | Knoeppel et al. |
| 2006/0141409 | A1 | 6/2006 | Chian et al. |
| 2006/0199122 | A1 | 9/2006 | Matteson et al. |
| 2006/0275719 | A1 | 12/2006 | Hill et al. |
| 2006/0275720 | A1 | 12/2006 | Hotton et al. |
| 2007/0125764 | A1 | 6/2007 | Knoeppel et al. |
| 2008/0080844 | A1 | 4/2008 | Miller et al. |
| 2008/0164334 | A1 | 7/2008 | Knoeppel et al. |
| 2008/0302784 | A1 | 12/2008 | Knoeppel et al. |
| 2009/0038944 | A1 | 2/2009 | Kruger |
| 2010/0116812 | A1 | 5/2010 | Watson et al. |
| 2010/0122978 | A1 | 5/2010 | Oh et al. |

FOREIGN PATENT DOCUMENTS

| | | |
|---|---|---|
| DE | 3916847 | 11/1990 |
| DE | 19609892 | 9/1997 |
| DE | 10145575 | 4/2003 |
| EP | 1426467 | 6/2004 |
| EP | 1640478 | 3/2006 |
| EP | 1813698 | 8/2007 |
| GB | 1423959 | 2/1976 |
| JP | 59035686 | 2/1984 |
| JP | 62228494 | 10/1987 |
| JP | 08176858 | 7/1996 |

OTHER PUBLICATIONS

Andrew R. Caves et al., U.S. Appl. No. 12/021,416, filed Jan. 29, 2008.

Andrew R. Caves et al., U.S. Appl. No. 12/021,406, filed Jan. 29, 2008.

International Search Report and Written Opinion of the International Searching Authority for PCT/US2008/052343 dated Jul. 4, 2008 (11 pages).

STORAGE-TYPE WATER HEATER HAVING TANK CONDITION MONITORING FEATURES

RELATED APPLICATIONS

This patent application claims the benefit of U.S. provisional patent application No. 60/968,424, filed on Aug. 28, 2007, the entirety of which is hereby incorporated by reference.

FIELD OF THE INVENTION

The invention relates to a storage-type water heater having a powered anode and methods of using the powered anode to evaluate the condition of the water storage tank.

BACKGROUND

Powered anodes have been used in the water heater industry to protect exposed steel within the water storage tank from corrosion. In such systems, an anode is typically constructed with a metal such as platinum or titanium and extends into the water held in the water storage tank. A current is then applied through the anode to prevent the exposed steel from oxidizing and corroding. In some such systems, the amount of current required to adequately protect the exposed steel is dependent upon, among other things, the quality and material of the tank lining, and the electrical conductivity of the water within the tank. In at least one system, the applied current is adjusted as the internal lining of the tank wears away and more steel becomes exposed to the water.

SUMMARY

As the internal lining wears away, the amount of current required to protect the exposed steel of the water storage tank increases. However, due to practical limitations, the amount of current applied through the anode may be less than a value necessary to protect the tank. This may result in the deterioration of the lining of the water storage tank. Although the powered anode is able to delay the failure of the water storage tank, eventually the metal will corrode and the water storage tank will begin to leak.

One embodiment provides a storage-type water heater that includes a water storage tank, a powered anode, and a controller. The water storage tank is constructed with a metal and an internal lining coupled to the metal. The powered anode is at least partially disposed in the water storage tank. The controller is configured to measure a first parameter of the powered anode and to adjust the current of the powered anode based on the first parameter. The controller is also configured to measure a second parameter of the powered anode and generate a signal when the second parameter exceeds a threshold. In some embodiments, the second parameter is indicative of a degree of exposure of the metal of the water storage tank.

In some embodiments, the threshold is a value indicative of the degree of exposure of the metal of the water storage tank at which the powered anode does not adequately protect the metal of the storage tank from corrosion. In some embodiments, the threshold is a value indicative of a predicted failure of the water storage tank. In some embodiments, the threshold is adjusted depending upon the type of water storage tank. In some embodiments, the threshold is adjusted depending upon the type of water or the source of the water stored in the water storage tank.

In some embodiments, the controller is configured to calculate an estimated time remaining until a failure of the water storage tank based upon a measured parameter of the powered anode. In some embodiments, the controller is configured to drain the water from the water storage tank before the storage tank fails.

Some embodiments provide a storage-type water heater that includes a water storage tank, a powered anode, and a controller. The controller is configured to determine a threshold predicative of a failure of the water storage tank based upon the type of water storage tank and the type of water stored therein. The controller is also configured to measure the powered anode current, and calculate an estimated time remaining until a failure of the water storage tank.

Some embodiments provide a method of predicting a failure of the water storage tank in a storage-type water heater. A threshold predicative of a failure is determined based upon the type of water storage tank and the type of water stored therein. The electric potential of the powered anode relative to the water storage tank is measured and the current of the powered anode is adjusted until the measured electric potential approaches a target electric potential. A signal is generated when the measured current applied to the powered anode exceeds the threshold.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that certain terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected," "supported," and "coupled" are used broadly and encompass both direct and indirect mounting, connecting, supporting, and coupling. Further, "connected" and "coupled" are not restricted to physical or mechanical connections or couplings, and can include electrical connections or couplings, whether direct or indirect.

As should also be apparent to one of ordinary skill in the art, some of the modules and logical structures described are capable of being implemented in software executed by a processor or a similar device or of being implemented in hardware using a variety of components including, for example, application specific integrated circuits ("ASICs"). Terms like "processor", "filter", and "controller" may include or refer to hardware and/or software. Thus, the claims should not be limited to the specific examples or terminology or to any specific hardware or software implementation or combination of software or hardware.

Figure 1:
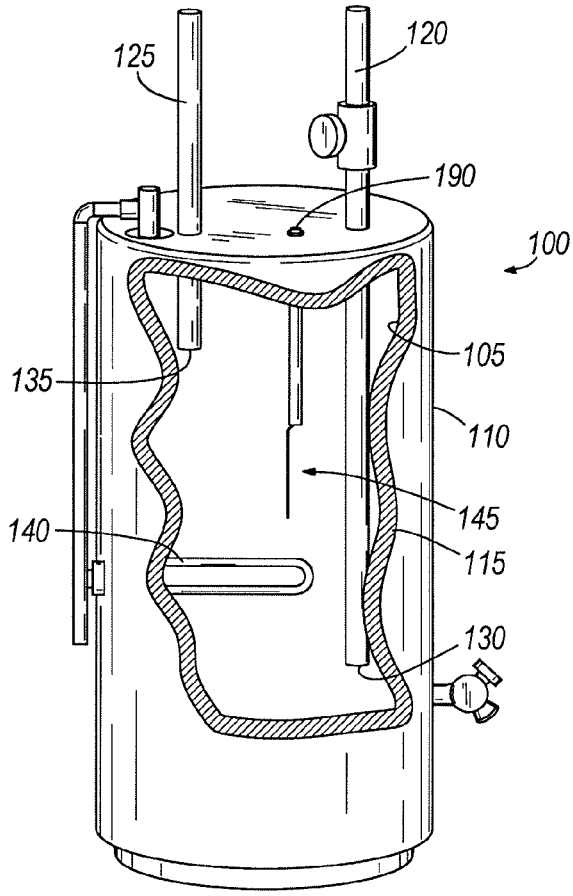
FIG. 1 is partial-exposed view of a water heater embodying the invention.

FIG. 1 illustrates a water heater 100 including an enclosed water tank 105, a shell 110 surrounding the water tank 105, and foam insulation 115 filling the annular space between the water tank 105 and the shell 110. A typical storage tank 105 is made of ferrous metal and lined internally with a glass-like porcelain enamel to protect the metal from corrosion. Nevertheless, the protective lining may have imperfections or, of necessity, may not entirely cover the ferrous metal interior. Under these circumstances, an electrolytic corrosion cell may be established as a result of dissolved solids in the stored water, leading to corrosion of the exposed ferrous metal and to reduction of service life for the water heater 100.

A water inlet line or dip tube 120 and a water outlet line 125 enter the top of the water tank 105. The water inlet line 120 has an inlet opening 130 for adding cold water to the water tank 105, and the water outlet line 125 has an outlet opening 135 for withdrawing hot water from the water tank 105. The water heater 100 also includes an electric resistance heating element 140 that is attached to the tank 105 and extends into the tank 105 to heat the water. The heating element 140 typically includes an internal high resistance heating element wire surrounded by a suitable insulating material and enclosed in a metal jacket. Electric power for the heating element 140 is typically supplied from a control circuit. While a water heater 100 having element 140 is shown, the invention can be used with other water heater types, such as a gas water heater, and with other water heater element designs. It is also envisioned that the invention or aspects of the invention can be used in other fluid storage devices.

Figure 2:
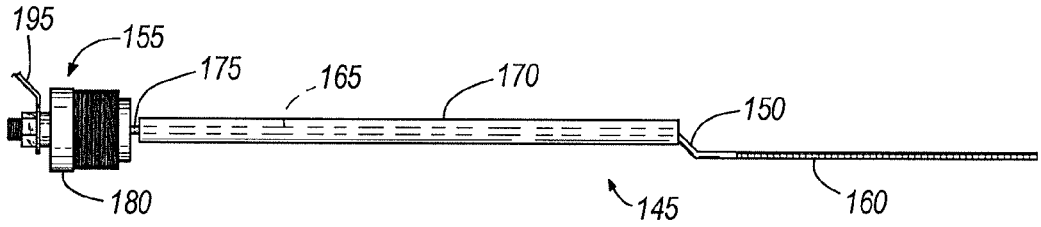
FIG. 2 is a side view of an electrode capable of being used in the water heater of FIG. 1.

An electrode assembly 145 is attached to the water heater 100 and extends into the tank 105 to provide corrosion protection to the tank. An example electrode assembly 145 capable of being used with the water heater is shown in FIG. 2. With reference to FIG. 2, the electrode assembly 145 includes an electrode wire 150 and a connector assembly 155. The electrode wire 150 comprises titanium and has a first portion 160 that is coated with a metal-oxide material and a second portion 165 that is not coated with the metal-oxide material. During manufacturing of the electrode assembly 145, a shield tube 170, comprising PEX or polysulfone, is placed over a portion of the electrode wire 150. The electrode wire 150 is then bent twice (e.g., at two forty-five degree angles) to hold the shield tube in place. A small portion 175 of the electrode wire 150 near the top of the tank is exposed to the tank for allowing hydrogen gas to exit the shield tube. In other constructions, the electrode assembly 145 does not include the shield tube 170. The connector assembly 155 includes a spud 180 having threads, which secure the electrode rod assembly to the top of the water tank 105 by mating with the threads of opening 190 (FIG. 1). Other connector assemblies known to those skilled in the art can be used to secure the electrode assembly 145 to the tank 105. The connector assembly also includes a connector 195 for electrically connecting the electrode wire 150 to a control circuit (discussed below). Electrically connecting the electrode assembly 145 to the control circuit results in the electrode assembly 145 becoming a powered anode. The electrode wire 150 is electrically isolated from the tank 105 to allow for a potential to develop across the electrode wire 150 and the tank 105. Other electrode assembly designs can be used with the invention.

Figure 3:
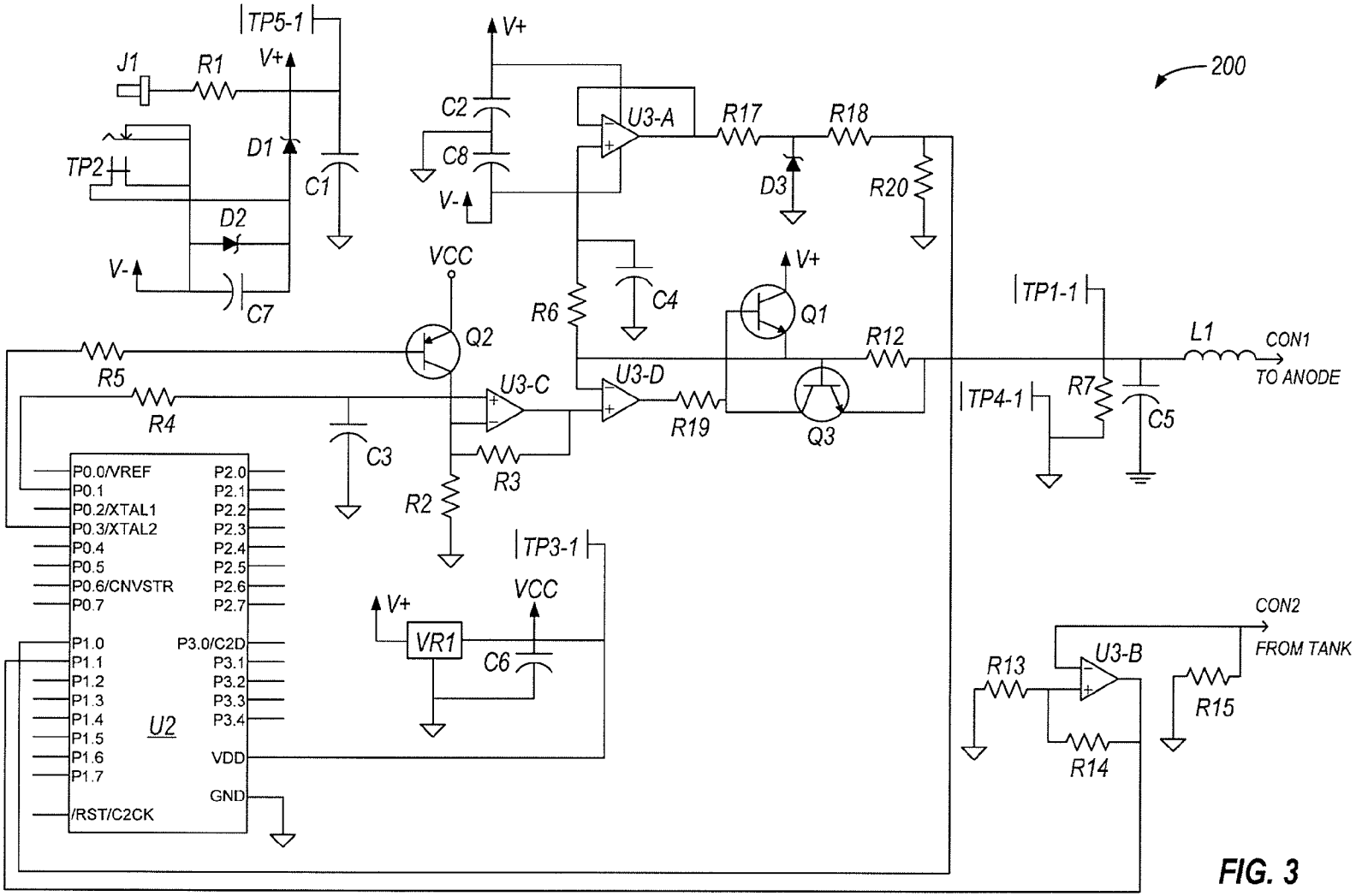
FIG. 3 is an electric schematic of a controller capable of controlling the electrode of FIG. 2.

An electronic schematic for one construction of the control circuit 200 used for controlling the electrode assembly 145 is shown in FIG. 3. The control circuit includes a microcontroller U2. An example microcontroller U2 used in one construction of the control circuit 200 is a Silicon Laboratories microcontroller, model no. 8051F310. As will be discussed in more detail below, the microcontroller U2 receives signals or inputs from a plurality of sensors, analyzes the inputs, and generates outputs to control the electrode assembly 145. In addition, the microcontroller U2 can receive other inputs (e.g., inputs from a user) and can generate outputs to control other devices (e.g., the heating element 140).

The microcontroller includes a processor and memory. The memory includes one or more modules having instructions. The processor obtains, interprets, and executes the instructions to control the water heater 100, including the electrode assembly 145. Although the microcontroller U2 is described having a processor and memory, the invention may be implemented with other devices including a variety of integrated circuits (e.g., an application-specific-integrated circuit) and discrete devices, as would be apparent to one of ordinary skill in the art.

The microcontroller U2 outputs a pulse-width-modulated (PWM) signal at P0.1. Generally speaking, the PWM signal controls the voltage applied to the electrode wire 150. A one hundred percent duty cycle results in full voltage being applied to the electrode wire 150, a zero percent duty cycle results in no voltage being applied to the electrode wire 150, and a ratio between zero and one hundred percent will result in a corresponding ratio between no and full voltage being applied to the electrode wire 150.

The PWM signal is applied to a low-pass filter and amplifier, which consists of resistors R2, R3, and R4; capacitor C3; and operational amplifier U3-C. The low-pass filter converts the PWM signal into an analog voltage proportional to the PWM signal. The analog voltage is provided to a buffer and current limiter, consisting of operational amplifier U3-D, resistors R12 and R19, and transistors Q1 and Q3. The buffer and current limiter provides a buffer between the microcontroller U2 and the electrode assembly 145 and limits the current applied to the electrode wire 150 to prevent hydrogen buildup. Resistor R7, inductor L1, and capacitor C5 act as a filter to prevent transients and oscillations. The result of the filter is a voltage that is applied to the electrode assembly 145, which is electrically connected to CON1.

As discussed later, the drive voltage is periodically removed from the electrode assembly 145. The microcontroller deactivates the drive voltage by controlling the signal applied to a driver, which consists of resistor R5 and transistor Q2. More specifically, pulling pin P0.3 of microcontroller U2 low results in the transistor Q1 turning OFF, which effectively removes the applied voltage from driving the electrode assembly 145. Accordingly, the microcontroller U2, the low-pass filter and amplifier, the buffer and current limiter, the filter, and the driver act as a variable voltage supply that controllably applies a voltage to the electrode assembly 145, resulting in the powered anode. Other alternative circuit designs can also be used to controllably provide a voltage to the electrode assembly 145.

The connection CON2 provides a connection that allows for an electrode return current measurement. More specifically, resistor R15 provides a sense resistor that develops a signal having a relation to the current at the tank. Operational amplifier U3-B and resistors R13 and R14 provide an amplifier that provides an amplified signal to the microcontroller U2 at pin P1.1. Accordingly, resistor R15 and the amplifier form a current sensor. However, other current sensors can be used in place of the sensor just described. Furthermore, in some constructions, a similar current sensor is configured to monitor the current at CON1 (i.e., at the anode).

With the removal of the voltage, the potential at the electrode 145 drops to a potential that is offset from, but proportional to, the open circuit or "natural potential" of the electrode 145 relative to the tank 105. A voltage proportional to the natural potential is applied to a filter consisting of resistor R6 and capacitor C4. The filtered signal is applied to operational amplifier U3-A, which acts as a voltage follower. The output of operational amplifier U3-A is applied to a voltage limiter (resistor R17 and zener diode D3) and a voltage divider (resistor R18 and R20). The output is a signal having a relation to the natural potential of the electrode assembly 145, which is applied to microcontroller U2 at pin P1.0. Accordingly, the just-described filter, voltage follower, voltage limiter, and voltage divider form a voltage sensor. However, other voltage sensors can be used in place of the disclosed voltage sensor.

The control circuit 200 controls the voltage applied to the electrode wire 150 and, thereby, controls the current through the powered anode. As will be discussed below, the control circuit 200 also measures tank protection levels, adapts to changing water conductivity conditions, and adapts to electrode potential drift in high conductivity water. In addition, when the control circuit 200 for the electrode assembly 145 is combined or in communication with the control circuit for the heating element 140, the resulting control circuit can take advantage of the interaction to provide additional control of the water heater.

Figure 4:
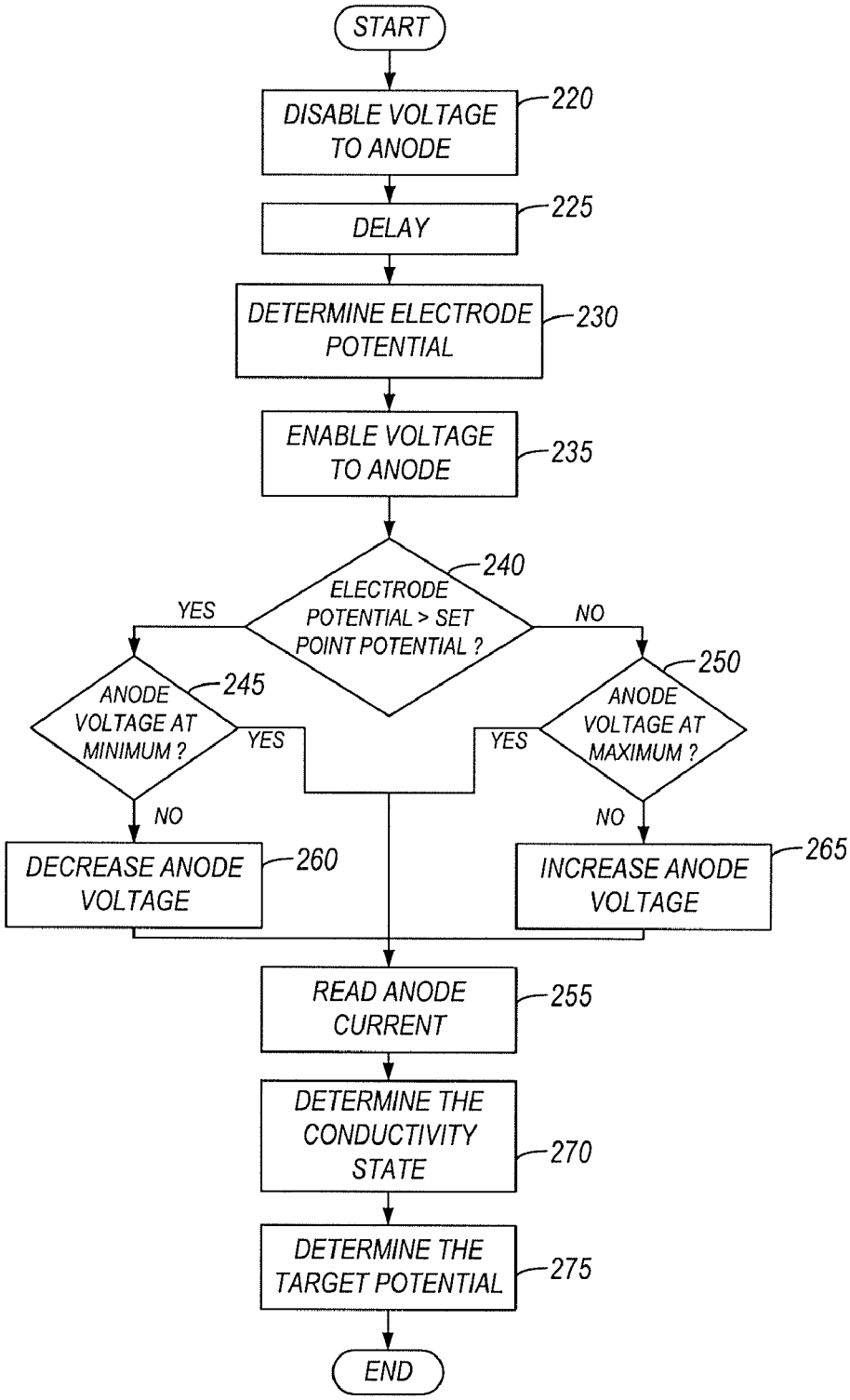
FIG. 4 is a flow chart of a subroutine capable of being executed by the control circuit shown in FIG. 3 in which an electrode potential is adjusted by the control circuit.

FIG. 4 provides one method of controlling the electrode assembly 145. Before proceeding to FIG. 4, it should be understood that the order of steps disclosed could vary. Furthermore, additional steps can be added to the control sequence and not all of the steps may be required. During normal operation, voltage is applied from the control circuit 200 to the electrode assembly 145. Periodically (e.g., every 100 ms), an interrupt occurs and the control circuit enters the control loop shown in FIG. 4.

With reference to FIG. 4, the control circuit 200 disables the voltage applied to the electrode assembly 145 (block 220). After disabling the voltage, the control circuit 200 performs a delay (block 225), such as 250 μs, and determines an electrode potential (block 230). The control circuit 200 performs the delay to allow the electrode assembly 145 to relax to its open circuit. The microcontroller U1 then acquires this potential from the voltage sensor. The control circuit 200 then reapplies the voltage to the electrode assembly 145 (block 240). At block 240, the control circuit 200 determines whether the electrode potential is greater than a target potential. If the electrode potential is greater than the target potential, the control circuit proceeds to block 245; otherwise the control proceeds to block 250.

At block 245, the control circuit 200 determines whether the applied voltage is at a minimum value. If the applied voltage is at the minimum, the control circuit 200 proceeds to block 255; otherwise the control circuit 200 proceeds to block 260. At block 260, the control circuit decreases the applied voltage.

At block 250, the control circuit 200 determines whether the applied voltage is at a maximum value. If the applied voltage is at the maximum, the control circuit 200 proceeds to block 255; otherwise the control circuit proceeds to block 265. At block 265, the control circuit 200 increases the applied voltage. By decreasing or increasing the applied voltage at block 260 or 265, respectively, the control circuit 200 can indirectly adjust the electrode potential. Increasing the applied voltage will result in an increase in the tank potential measured by the electrode and decreasing the applied voltage will decrease the tank potential measured by the electrode. Therefore, the control circuit 200 can adjust the open circuit potential of the electrode until it reaches the target potential. Furthermore, as the characteristics of the water heater 100 change, the control circuit 200 can adjust the voltage applied to the electrode to have the open circuit potential of the electrode equal the target point potential.

At block 255, the control circuit acquires an electrode current. More specifically, the microcontroller U1 receives a signal that represents a sensed current form the current sensor. At block 270, the control circuit determines a conductivity state of the water. For example, the conductivity state can be either a high conductivity for the water or a low conductivity for the water. To determine the conductivity state (either high or low), the microcontroller U1 divides the applied current by an incremental voltage, which is equal to the applied voltage minus the open circuit potential. If the resultant is less than an empirically set value, then the control circuit 200 determines the conductivity state is low and sets the target potential to a first value; otherwise the control circuit sets the target potential to a second value indicating a high conductivity state (block 275). The control circuit 200 can repeatedly perform the conductivity test during each interrupt (as shown in FIG. 4), periodically perform the conductivity test at a greater interval than the setting of the electrode voltage, or perform the conductivity test only during a startup sequence. Additionally, while only two set points are shown, it is envisioned that multiple set points can be used. It is also envisioned that other methods can be used to determine the conductivity state of the water. For example, a ratio of the applied current divided by the applied voltage can be used to determine the conductivity state.

In addition to establishing a set point, the control circuit 200 can use the acquired current to determine whether the water heater 100 is in a dry-fire state. The term "dry fire" refers to the activation of a water heater that is not storing a proper amount of water. Activation of a heating element (e.g., an electric resistance heating element or a gas burner) of a water heater in a dry-fire state may result in damage to the water heater. For example, if water is not properly surrounding the electric resistance heating element 140, then the electric resistance heating element may burnout in less than a minute when voltage is applied to the heating element 140. Therefore, it is beneficial to reduce the likelihood of activating the heating element 140 if the water heater 100 is in a dry-fire state. If the acquired current is less than a minimum value (e.g., essentially zero), then it is assumed that the water heater 100 is not storing the proper amount of water and the control circuit 200 prevents the activation of the heating element 140. It is also envisioned that other methods for determining a dry-fire state can be used. For example, the control circuit 200 can be designed in such a fashion that the electrode potential will be approximately equal to the applied voltage under dry fire conditions.

As the storage tank 105 (FIG. 1) ages, the internal porcelain enamel lining deteriorates and more of the ferrous metal is exposed to the water stored in the storage tank 105. As the amount of exposed metal surface area increases, the amplitude of the powered anode current must also be increased in order to adequately protect the exposed ferrous metal. However, the maximum amount of current that can safely be applied to the system may be limited. For example, electric current can cause the water to ionize which produces excessive hydrogen within the sealed tank and the hydronium produced by this reaction can give the heated water an unpleasant odor. Furthermore, excessive electrical current applied to the water can create the risk of a shock to those people using the heated water. Therefore, as the internal lining deteriorates, the water heater will reach a point where the powered anode is no longer able to adequately protect the exposed metal of the storage tank 105. The storage tank 105 will eventually corrode and begin to leak.

As discussed above, the control circuit 200 (FIG. 3) is configured to monitor the potential of the electrode 145 (FIG. 1) relative to the tank and to monitor the current at the tank or at the electrode 145. Utilizing data from these measurements, the control circuit is able evaluate the protection provided by the powered anode. Among other things, the control circuit 200 detects when the powered anode is no longer sufficient to protect the tank from corrosion and estimates a remaining time until failure of the storage tank. The controller may also be configured to take adaptive action based upon this information, such as, for example, initiating the draining of water from the storage tank or sending a signal to a repair specialist.

Figure 5:
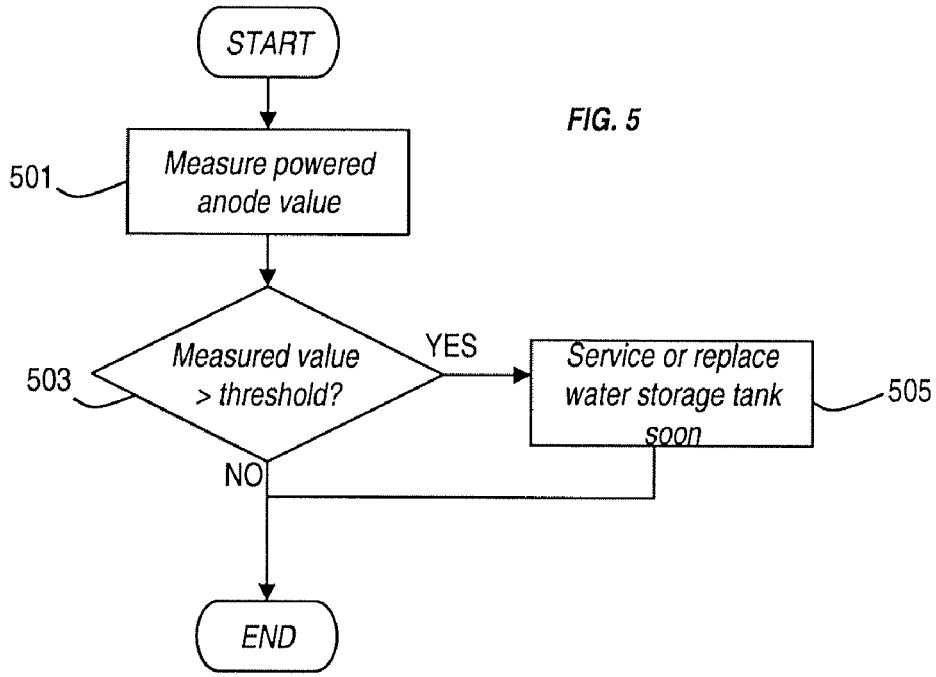
FIG. 5 is a flow chart of a subroutine capable of being executed by the control circuit shown in FIG. 3 in which the control circuit evaluates a condition of the water storage tank based upon a threshold.

FIG. 5 illustrates one method of determining when the powered anode is no longer able to adequately protect the storage tank 105 (FIG. 1). At block 501, the control circuit 200 measures the powered anode current. In some constructions, this is measured as the current at or through the powered anode. In some constructions, this is measured as the current at the tank provided from the powered anode. In either case, a value is returned to the microcontroller U2 that is indicative of the electrical current required to protect the metal of the storage tank 105.

At block 503, this value is compared to a threshold. This threshold is indicative of a state of the storage tank 105 (FIG. 1) such as the amount of exposed metal inside the tank that renders the powered anode insufficient to protect against corrosion. Alternatively, in some constructions, this threshold is indicative of a level of electric current that will cause an undesirable or dangerous condition in the water. If the value is less than the threshold, the water heater continues to operate and periodically repeats the subroutine of FIG. 5. If, however, the value is greater than the threshold, the control circuit 200 indicates that the storage tank is in need of repair or replacement (block 505).

Figure 6:
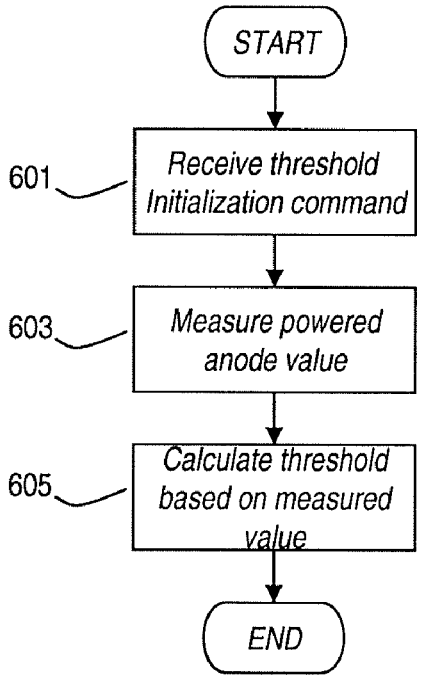
FIG. 6 is a flow chart of a subroutine capable of being executed by the control circuit shown in FIG. 3 in which the control circuit calculates a value of the threshold.

Different types of water react differently with various types of metals. Therefore, the applicable threshold might be varied depending upon the type of storage tank and the type of water stored therein. FIG. 6 illustrates one method of setting the threshold of block 503 (FIG. 5) based upon sensed conditions. At block 601, the control circuit receives a threshold initialization command. This command may be initiated automatically upon the first consumer use of the water heater or upon other conditions such as, for example, a command received through a user input device. At block 603, the powered anode current is measured and the control circuit 200 receives a value indicative of the amount of electric current required to protect the storage tank. At block 605, the threshold is calculated based upon the measured current at the time of the initialization command. This calculation may include, for example, multiplying the measured value by a predetermined value.

In some constructions that utilize the same universal controller for multiple various water storage tanks, the threshold of block 503 is set low enough that the threshold would be exceeded before any storage tank using the universal controller would fail and begin to leak. In alternative constructions, the universal controller receives the water tank type and the water type as inputs and selects a threshold based upon these variables. In some such constructions, the universal controller includes a memory that stores a list of possible thresholds. As discussed above, control circuit 200 includes circuitry that is used to evaluate the conductivity of the water. As such, a universal controller such as the control circuit 200 can set the threshold based in part on the observed conductivity of the water. Other constructions include circuitry configured to evaluate characteristics of the water such as pH and set the threshold based in part on the observed characteristic.

Figure 7:
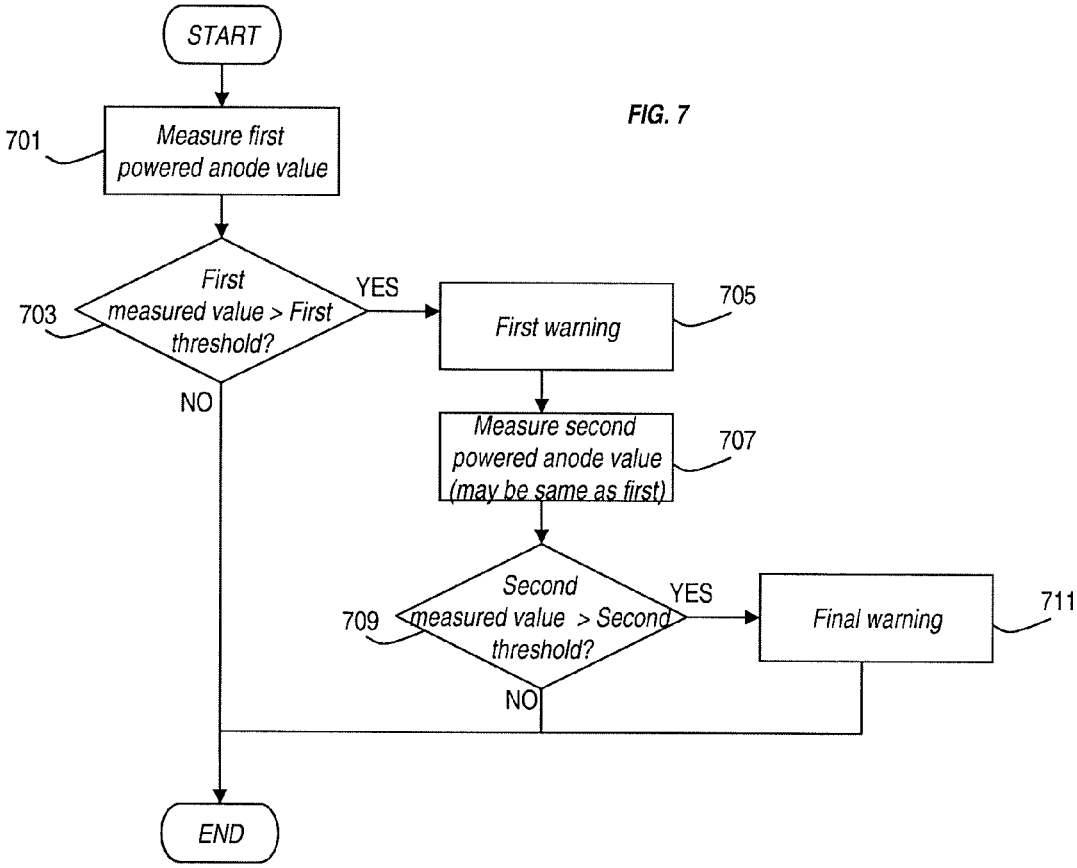
FIG. 7 is a flow chart of a subroutine capable of being executed by the control circuit shown in FIG. 3 in which the control circuit evaluates a condition of the water storage tank based upon dual thresholds.

In some constructions, the control circuit 200 is configured to monitor two thresholds, each indicative of a different parameter. In the illustration of FIG. 7, for example, control circuit 200 is programmed with a first threshold that is set low enough that the threshold would be exceeded before the storage tank fails and begins to leak regardless of the type of water stored therein. The second threshold is higher than the first and is calculated using the method illustrated in FIG. 6.

At block 701, the control circuit 200 measures the powered anode current and receives a value indicative of the electrical current required to protect the metal of the storage tank. At block 703, the value is compared to the first threshold. If the first threshold is not exceeded, the water heater continues to operate normally and periodically repeats the method illustrated in FIG. 7. If, however, the first threshold is exceeded, a control circuit 200 signals a warning (block 705). In this example, the second parameter is the same as the first (block 707). At block 709, the value is compared to the second, higher threshold. If the second threshold is not exceeded, the water heater continues to operate while signaling the first warning. If, however, the second threshold is exceeded, the control circuit 200 signals a final warning (block 711), indicating a heightened need for repair or replacement of the water storage tank.

In other constructions, the second threshold may be based upon a parameter that is different from the first threshold. As discussed above, the maximum current of the powered anode may be effectively capped based upon safety and comfort considerations. In this example, the first threshold is set as the maximum desired output current of the powered anode. Because the current of the powered anode is not increased beyond this maximum current in response to additional exposed metal surface area, the measured potential of the tank relative to the powered anode will increase and will not be adjusted as illustrated in FIG. 4. The second threshold, therefore, is based upon a measured potential which indicates that the tank is corroding.

In this example, the current of the powered anode is measured at block 701. If the measured current does not exceed the first threshold at block 603, the water heater continues to operate normally and periodically repeats the subroutine illustrated in FIG. 7. If, however, the first threshold is exceeded, the control circuit 200 (FIG. 3) indicates a first warning (block 705) and measures the potential of the tank relative to the powered anode (block 707). If the second threshold is not exceeded at block 609, the water heater continues to operate while indicating the first warning and periodically repeats the subroutine of FIG. 7. If, however, the second threshold is exceeded, the control circuit 200 has determined that the tank is corroding and the current of the powered anode will no longer be increased to prevent this corrosion. A final warning is indicated at block 711.

This dual threshold system allows for multiple levels of protection depending upon the urgency of the observed tank degradation. For example, when the first threshold is exceeded at block 703, a warning can be displayed to the user (block 705). At this point, the tank shows signs of wear, but tank failure is not imminent. The user has time to repair or replace the water tank before it fails and begins to leak. However, depending upon where the second threshold is set, when the second threshold is exceeded at block 709, the potential for tank failure is a heightened concern. In addition to displaying the final warning at block 711, the water heater 100 (FIG. 1) can be configured to begin to safely drain the water from the storage tank and prevent the water damage that would result from a failed storage tank. In this type of dual threshold system, the first warning (block 705) gives the user an opportunity to repair or replace the storage tank before it is automatically drained (block 711). However, a single threshold system such as illustrated in FIG. 5 might also be configured to initiate a drain of the storage tank when the threshold is exceeded.

In some constructions, the control circuit 200 (FIG. 3) is configured to associate a measured parameter with an estimated time remaining until failure of the storage tank. In some constructions, the estimated time remaining is calculated based upon the measured current of the powered anode. In some constructions, the estimated time remaining is a set duration counting from the time that the threshold is exceeded. In some constructions, the estimated time remaining is calculated after the maximum current of the powered anode is exceeded based upon the measured potential of the tank relative to the powered anode.

Figure 8:
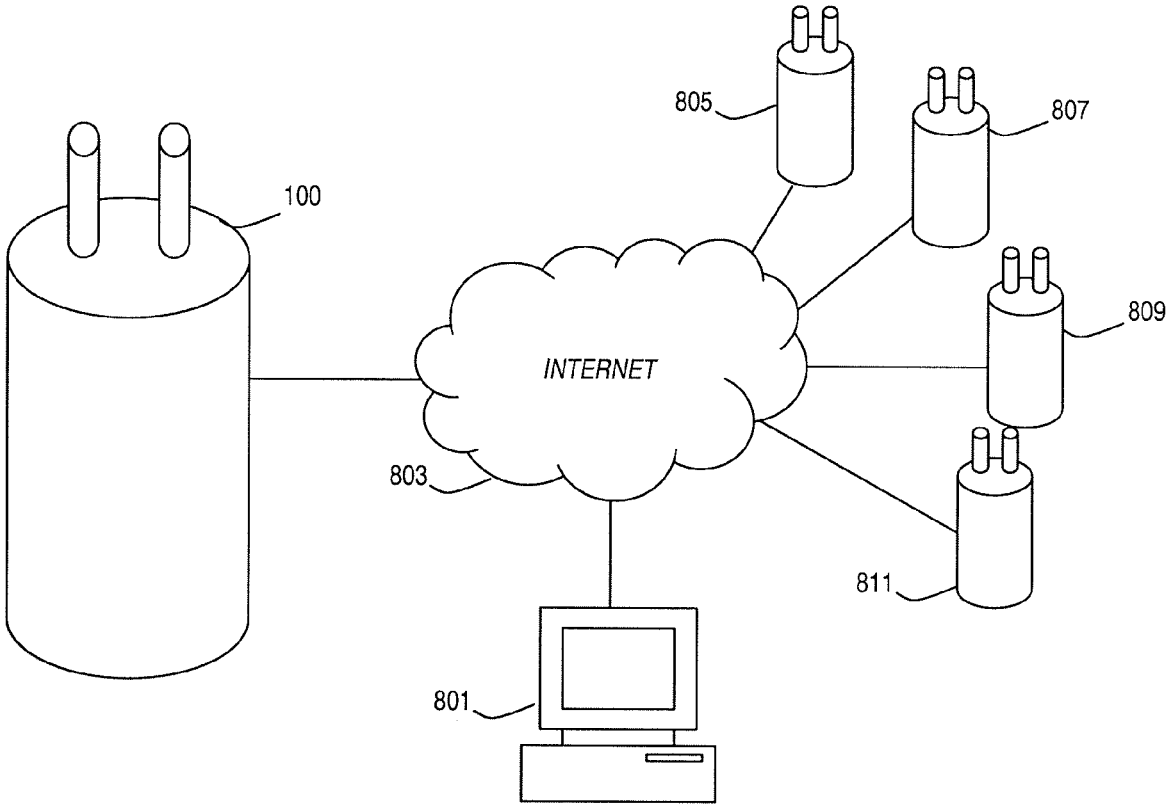
FIG. 8 is a block diagram showing a communication network including the water heater of FIG. 1.

In some constructions, the estimated time remaining and the threshold are determined based upon values received through a communication interface from a storage tank failure database. FIG. 8 illustrates one construction of a communication network including the water heater 100. Water heater 100 is connected to a remote computer system 801 through the Internet 803. Computer system 801 is also connected to various other water heater units such as 805, 807, 809, and 811. In such constructions, the control circuit 200 is configured to send operation data to and receive data from computer system 801.

Figure 9:
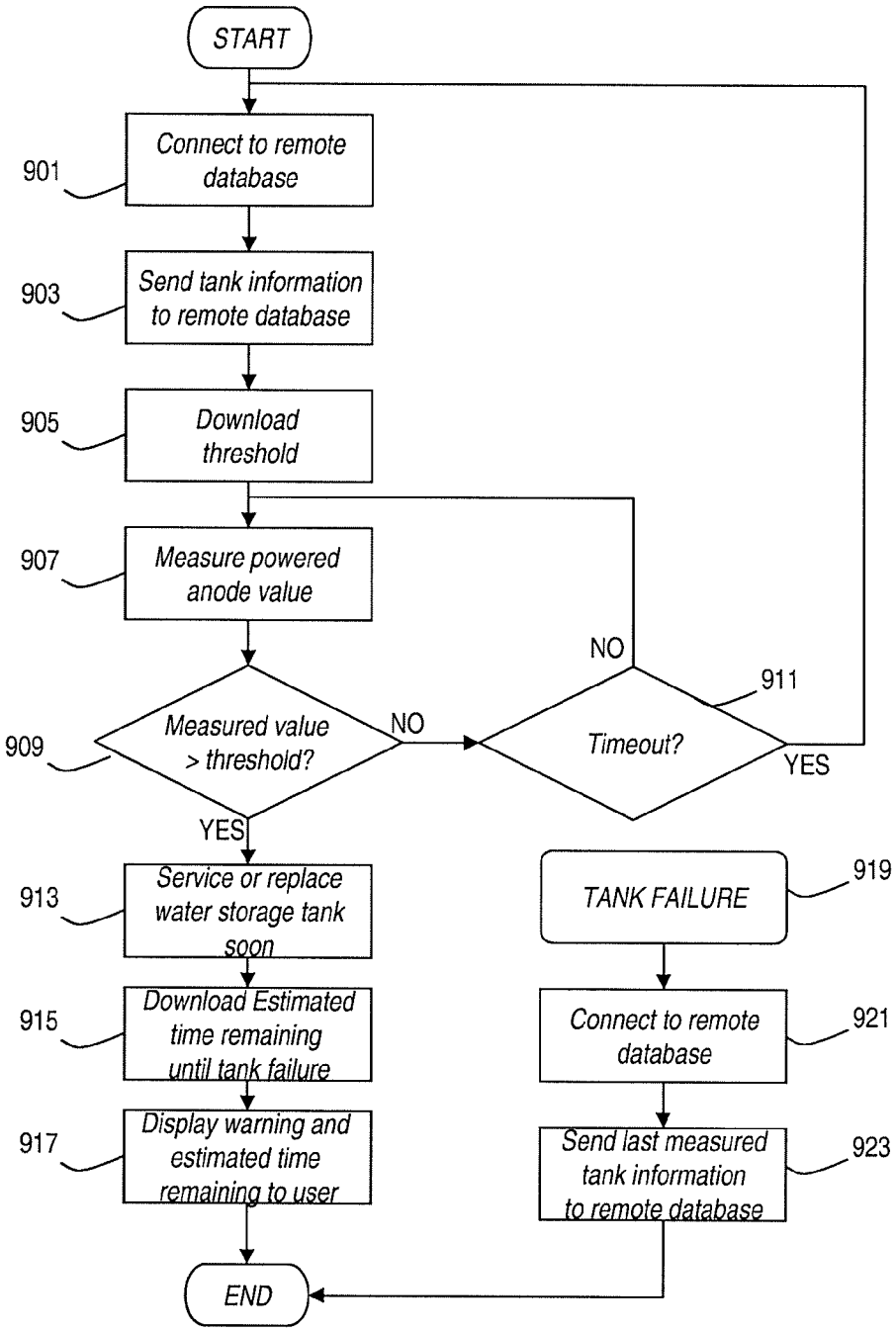
FIG. 9 is a flow chart of a subroutine capable of being executed by the control circuit shown in FIG. 3 in the communication network shown in FIG. 7.

FIG. 9 illustrates an example of how water heater 100 interacts with computer system 801. At block 901, water heater 100 establishes a connection with remote computer system 801. This can be through the Internet as shown in FIG. 8 or through another communication interface such as, for example, a telephone line. At block 903, water heater 100 sends tank information to the remote database. This information may include a unique water heater identifier, the model number of the storage tank, the duration of operation, and the measured conductivity of the water. At block 905, the water heater 100 receives a threshold value from remote computer system 801 based upon the tank information.

At block 907, the control circuit 200 measures the current of the powered anode. If the threshold is not exceeded at block 909, the water heater 100 continues to operate normally and periodically returns to block 907. When a timeout occurs during normal operation, the water heater returns to block 901 and reconnects to the remote computer system 801 (FIG. 8).

If, however, the threshold is exceeded, the water heater 100 sends an indication to the remote computer system at block 913. Based upon the tank information sent to the remote computer system at block 903, the water heater 100 receives an estimated time remaining (block 915). A warning and the estimated time remaining is displayed to the user at block 917.

If at any time during the operation of water heater 100, the storage tank fails (block 919), water heater 100 connects to the remote computer system (block 921) and sends the last measured tank information (block 923). This allows the remote computer system to update the database based upon the type of water, the type of storage tank, the elapsed time since the threshold was exceeded, and the actual electric current or electric potential values recorded at the time of failure. This type of data collection and analysis allows the remote computer system 801 (FIG. 8) to continually improve the accuracy of the thresholds and estimated time remaining until tank failure.

It should be understood that the constructions described above are exemplary and other configurations are possible. For example, the thresholds in the methods discussed above could be indicative of a variety of parameters including, for example, a current value measured at the powered anode, a current value measured at the tank, an electric potential of the powered anode relative to the tank, an electric potential of the tank relative to the powered anode, or an elapse time of operation since an event. Furthermore, the term "exceeded" is used generally to refer to a condition when a threshold is passed and, unless explicitly stated otherwise, it is not limited to situations when the measured value is of greater amplitude than the threshold. For example, if the measured parameter decreases in amplitude as the ability of the powered anode to protect the tank decreases, then the threshold will be "exceeded" when the measured value is less than the threshold. Various features and advantages of the invention are set forth in the following claims.

What is claimed is:

1. A storage-type water heater comprising:

a water storage tank including a metal and a lining coupled to the metal;

a powered anode at least partially disposed in the water storage tank; and a controller configured to measure a first parameter having a relation to the operation of the powered anode, adjust a current of the powered anode based on the first parameter, determine a second parameter having a relation to the current of the powered anode, and generate a signal relating to a condition of at least one of the metal and the lining of the water storage tank when the second parameter exceeds a threshold.

2. The storage-type water heater of claim 1, wherein the first parameter has a relation to an electric potential of the powered anode relative to a location.

3. The storage-type water heater of claim 2, wherein the controller is configured to adjust the current of the powered anode based upon the first parameter by adjusting the current of the powered anode until the electric potential of the powered anode relative to a location approaches a target electric potential.

4. The storage-type water heater of claim 2, wherein the location includes the metal of the water storage tank.

5. The storage-type water heater according to claim 1, wherein the metal of the water storage tank is at least partially exposed to water in the tank and the second parameter is indicative of a condition of the water storage tank.

6. The storage-type water heater according to claim 5, wherein the condition of the water storage tank includes the surface area of exposed metal in the water storage tank.

7. The storage-type water heater according to claim 5, wherein the condition of the water storage tank includes an amount of corrosion of the metal in the water storage tank.

8. The storage-type water heater according to claim 1, wherein the controller is further configured to set the threshold as a value indicative of a condition of the water storage tank where the powered anode does not adequately protect the metal of the storage tank from corrosion.

9. The storage-type water heater according to claim 1, wherein the controller is further configured to store the threshold as a value indicative of a potential failure of the water storage tank.

10. The storage-type water heater according to claim 1, wherein the controller is further configured to initiate the draining of water in response to the signal.

11. The storage-type water heater according to claim 1, wherein the controller is further configured to associate the threshold with an estimated time remaining until a failure of the water storage tank.

12. The storage-type water heater according to claim 1, wherein the controller is further configured to associate the amplitude of the second parameter with an estimated time remaining until a failure of the water storage tank.

13. The storage-type water heater according to claim 1, further comprising a computer readable memory containing a plurality of threshold values, wherein the controller is further configured to identify a type of water stored in the water storage tank; and select the threshold from the plurality of threshold values based upon the type.

14. The storage-type water heater according to claim 1, wherein the controller is further configured to evaluate a condition of water in the water storage tank; and set the threshold based upon the condition.

15. The storage-type water heater according to claim 1, wherein the controller is further configured to set the threshold as a multiple of a baseline measurement of the second parameter.

16. The storage-type water heater according to claim 15, wherein the baseline measurement includes the second parameter at a first consumer use of the storage-type water heater.

17. The storage-type water heater according to claim 15, further comprising a user input device, wherein the controller is further configured to receive a baseline initialization command from the user input device, and wherein the baseline measurement includes the second parameter when the baseline initialization command is received.

18. The storage-type water heater according to claim 1, wherein the controller is further configured to set the threshold as a value indicative of a rate of change of the current of the powered anode, and wherein the second parameter includes a present rate of change of the current of the powered anode.

19. The storage-type water heater according to claim 1, wherein the controller is further configured to set the threshold as a value indicative of a condition of the water storage tank where the powered anode does not adequately protect the metal of the storage tank from corrosion;

set a second threshold as a value indicative of a potential failure of the water storage tank; and generate a second signal when a third parameter exceeds the second threshold.

20. The storage-type water heater according to claim 19, wherein the third parameter is the first parameter or the second parameter.

21. The storage-type water heater according to claim 19, wherein the signal includes a warning and the second signal is directive to replace the water storage tank.

22. The storage-type water heater according to claim 21, wherein the controller is further configured to initiate the draining of water from the storage tank in response to the second signal.

23. The storage-type water heater according to claim 1, further comprising a communication interface, and wherein the controller is further configured to connect to a remote database via the communication interface; and receive a value of the threshold from the remote database.

24. The storage-type water heater according to claim 23, wherein the controller is further configured to receive an estimated time remaining until failure of the water storage tank from the remote database.

25. The storage-type water heater according to claim 23, wherein the controller is further configured to send a last measurement of the second parameter before a failure of the water storage tank to the remote database.

26. A storage-type water heater comprising:

a water storage tank configured to hold water, the water storage tank including a metal and a lining coupled to the metal;

a powered anode at least partially disposed in the water storage tank;

a controller configured to determine a threshold predicative of a failure of the water storage tank, the threshold being based upon a characteristic of the water storage tank and a characteristic of the water held in the water storage tank, measure a current of the powered anode, the measured current being indicative of a degree of exposure of the metal of the water storage tank, determine an estimated time remaining until a failure of the water storage tank, display the estimated time remaining to a user, and generate a signal when the measured current applied to the powered anode exceeds the threshold.

27. The storage-type water heater according to claim 26, wherein the characteristic of the water storage tank is an internal surface area of the water storage tank.

28. The storage-type water heater according to claim 26, wherein the characteristic of the water storage tank is a composition of the metal of the water storage tank.

29. The storage-type water heater according to claim 26, wherein the characteristic of the water storage tank is a model number of the water storage tank.

30. The storage-type water heater according to claim 26, wherein the characteristic of the water is a measurement of a conductivity of the water.

31. The storage-type water heater according to claim 26, wherein the characteristic of the water is a type of the water.

* * * * *